US010234782B2

(12) United States Patent
Kurano

(10) Patent No.: US 10,234,782 B2
(45) Date of Patent: Mar. 19, 2019

(54) ELECTROSTATIC LATENT IMAGE DEVELOPING CARRIER

(71) Applicant: KYOCERA Document Solutions Inc., Osaka (JP)

(72) Inventor: Yusuke Kurano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/973,678

(22) Filed: May 8, 2018

(65) Prior Publication Data

US 2018/0329331 A1 Nov. 15, 2018

(30) Foreign Application Priority Data

May 9, 2017 (JP) ..... 2017-092940

(51) Int. Cl.
*G03G 9/107* (2006.01)
*G03G 9/113* (2006.01)

(52) U.S. Cl.
CPC ..... *G03G 9/1134* (2013.01); *G03G 9/1136* (2013.01); *G03G 9/1139* (2013.01)

(58) Field of Classification Search
CPC ..... G03G 9/107; G03G 9/1075; G03G 9/113; G03G 9/1131
See application file for complete search history.

(56) References Cited

U.S. PATENT DOCUMENTS

2016/0246194 A1* 8/2016 Tsurumi ..... G03G 9/0823

FOREIGN PATENT DOCUMENTS

JP S56-075659 A 6/1981

* cited by examiner

*Primary Examiner* — Hoa V Le
(74) *Attorney, Agent, or Firm* — Studebaker & Brackett PC

(57) ABSTRACT

Carrier particles each include a carrier core having recesses in a surface thereof, and first and second coat layers covering the surface of the carrier core. The first and second coat layers are in a multi-layer structure in which the first coat layer and the second coat layer cover the surface of the carrier core in the stated order. The first coat layer entirely covers the surface of the carrier core. The second coat layer selectively covers regions of a surface of the first coat layer that correspond to the recesses in the surface of the carrier core. The first coat layer contains a first resin. The second coat layer contains a second resin. The second coat layer has a lower electric resistance than the first coat layer.

9 Claims, 2 Drawing Sheets

ELECTROSTATIC LATENT IMAGE DEVELOPING CARRIER

INCORPORATION BY REFERENCE

The present application claims priority under 35 U.S.C. § 119 to Japanese Patent Application No. 2017-092940, filed on May 9, 2017. The contents of this application are incorporated herein by reference in their entirety.

BACKGROUND

The present disclosure relates to an electrostatic latent image developing carrier.

A known two-component developer contains an electrostatic latent image developing toner (referred to below simply as a "toner") and an electrostatic latent image developing carrier (referred to below simply as a "carrier"). The carrier for example positively charges the toner by friction therewith. Examples of usable carriers include a carrier including carrier cores and resin layers (resin-coated carrier). Ferrite particles can for example be used as the carrier cores. The resin layers cover surfaces of the respective carrier cores. Known resin layers for example include porous carbon black having specific physical properties.

SUMMARY

An electrostatic latent image developing carrier according to an aspect of the present disclosure positively charges an electrostatic latent image developing toner by friction therewith. Specifically, the electrostatic latent image developing carrier according to the aspect of the present disclosure includes carrier particles. Each of the carrier particles includes a carrier core having recesses in a surface thereof, and first and second coat layers covering the surface of the carrier core. The first and second coat layers are in a multi-layer structure in which the first coat layer and the second coat layer cover the surface of the carrier core in the stated order. The first coat layer entirely covers the surface of the carrier core. The second coat layer selectively covers regions of a surface of the first coat layer that correspond to the recesses in the surface of the carrier core. The first coat layer contains a first resin. The second coat layer contains a second resin. The second coat layer has a lower electric resistance than the first coat layer. At least the second coat layer, among the first and second coat layers, contains titanium oxide. The first coat layer has a lower titanium oxide content than the second coat layer. The first coat layer contains the titanium oxide in an amount of at least 0 parts by mass and no greater than 2 parts by mass relative to 100 parts by mass of the first resin. The second coat layer contains the titanium oxide in an amount of at least 4 parts by mass and no greater than 10 parts by mass relative to 100 parts by mass of the second resin.

DETAILED DESCRIPTION

Figure 1:
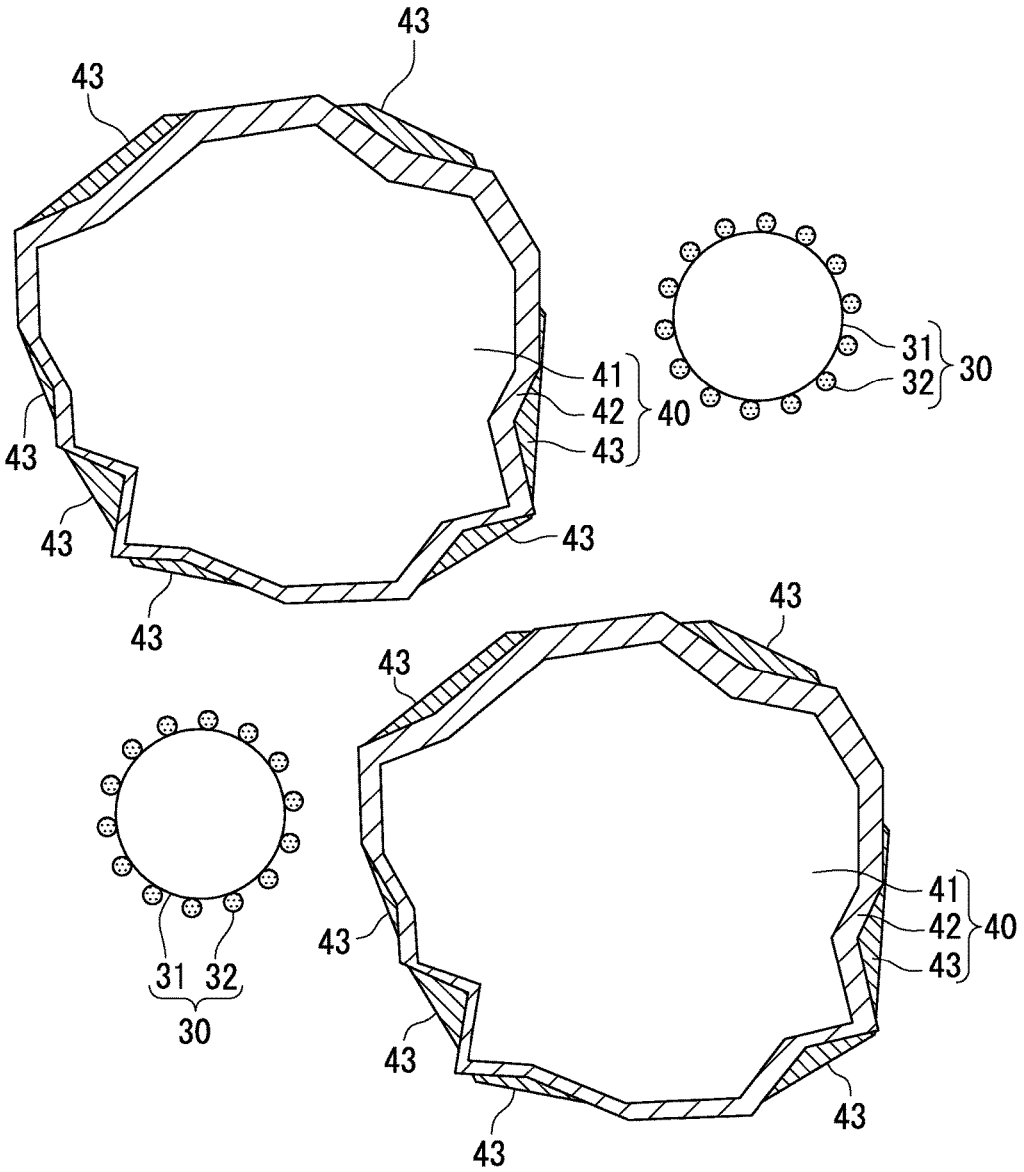
FIG. 1 is a diagram illustrating an example of a composition of a two-component developer containing an electrostatic latent image developing carrier according to an embodiment of the present disclosure.

The following describes an embodiment of the present disclosure. Unless otherwise stated, evaluation results (for example, values indicating shape and physical properties) for particles (specific examples include toner mother particles, external additive, toner, and carrier) are each a number average of values measured for a suitable number of average particles selected from among the particles.

A number average particle diameter of particles is a number average of equivalent circle diameters of primary particles thereof (diameters of circles having the same areas as projected areas of the particles) measured using a microscope, unless otherwise stated. A value for volume median diameter ($D_{50}$) of particles is measured using a laser diffraction/scattering particle size distribution analyzer ("LA-750", product of Horiba, Ltd.), unless otherwise stated.

Strength of chargeability is equivalent to ease of triboelectric charging, unless otherwise stated. A toner can for example be triboelectrically charged by mixing and stirring the toner with a standard carrier (anionic standard carrier: N-01, cationic standard carrier: P-01) provided by The Imaging Society of Japan. Surface potential of a toner particle is measured before and after the triboelectric charging using for example a kelvin probe force microscope (KFM). A portion having a larger change in potential before and after the triboelectric charging has stronger chargeability.

The term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" is used as a generic term for both acryl and methacryl. The term "(meth)acrylonitrile" is used as a generic term for both acrylonitrile and methacrylonitrile.

"Regions that correspond to recesses in a surface of a carrier core" as used herein mean regions respectively overlap the recesses in the surface of the carrier core. Likewise, "regions that correspond to projections of a surface of a carrier core" as used herein mean regions respectively overlap the projections of the surface of the carrier core. Note that "projections of a surface of a carrier core" mean remaining regions of the surface of the carrier core other than recesses in the surface of the carrier core.

Titanium oxide contained in a first coat layer is also referred to as "first titanium oxide". Titanium oxide contained in a second coat layer is also referred to as "second titanium oxide". A "first titanium oxide content of the first coat layer" means a ratio of the amount (mass) of the first titanium oxide contained in the first coat layer relative to the amount (mass) of the first resin contained in the first coat layer. A "second titanium oxide content of the second coat layer" means a ratio of the amount (mass) of the second titanium oxide contained in the second coat layer relative to the amount (mass) of the second resin contained in the second coat layer. The cases where "the first titanium oxide content of the first coat layer is lower than the second titanium oxide content of the second coat layer" encompass the case where the amount the first titanium oxide in the first coat layer is 0 parts by mass. That is, titanium oxide may be contained only in the second coat layer rather than both in the first coat layer and in the second coat layer.

[Basic Feature of Carrier]

A carrier according to the present embodiment includes carrier particles. Each of the carrier particles includes a carrier core having recesses in a surface thereof, and first and second coat layers covering the surface of the carrier core. The first and second coat layers are in a multi-layer structure in which the first coat layer and the second coat layer cover the surface of the carrier core in the stated order. The first coat layer entirely covers the surface of the carrier core. The second coat layer selectively covers regions of the surface of the first coat layer that correspond to the recesses in the surface of the carrier core. The first coat layer contains a first resin. The second coat layer contains a second resin. The second coat layer has a lower electric resistance than the first coat layer.

The carrier according to the present embodiment is preferably produced according to the method described below. Specifically, the method for producing the carrier according to the present embodiment includes a first coating step of covering the surface of each carrier core having projections and recesses with the first coat layer containing the first resin, a second coating step of covering the surface of the first coat layer with the second coat layer containing the second resin, and a stirring step of stirring the carrier cores covered with the first and second coat layers. Through the stirring step, regions of the surface of each second coat layer that correspond to the projections of the surface of the carrier core are scraped off to expose the corresponding first coat layer.

The carrier according to the present embodiment is produced as described above. Accordingly, the surface roughness of the carrier cores tends to have great influence on the surface roughness of the carrier particles. Specifically, regions of a surface of each carrier particle that correspond to the recesses in the surface of the carrier core thereof tend to be recessed compared to regions that correspond to the projections of the surface of the carrier core. In a two-component developer containing a toner and the carrier according to the present embodiment, therefore, the regions of the surface of each carrier particle that correspond to the recesses in the surface of the carrier core tend to collect the toner compared to the regions that correspond to the projections of the surface of the carrier core. As a result, triboelectric charging between the carrier and the toner occurs preferentially in the regions of the surface of the carrier particle that correspond to the recesses in the surface of the carrier core compared to the regions that correspond to the projections of the surface of the carrier core.

Each first coat layer in the carrier according to the present embodiment entirely covers the surface of the carrier core. Each second coat layer selectively covers regions of the surface of the first coat layer that correspond to the recesses in the surface of the carrier core. The second coat layer has a lower electric resistance than the first coat layer. Thus, the electric resistance of the coat layer covering regions of the surface of each carrier particle that correspond to the recesses in the surface of the carrier core thereof is lower than that of the coat layer covering regions that correspond to the projections of the surface of the carrier core. In the case of image formation using a two-component developer containing a toner and the carrier according to the present embodiment, therefore, the regions of the surface of each carrier particle that correspond to the recesses in the surface of the carrier core thereof tend to collect charges compared to the regions that correspond to the projections of the surface of the carrier core. As described above, triboelectric charging between the carrier according to the present embodiment and the toner occurs preferentially in the regions of the surface of each carrier particle that correspond to the recesses in the surface of the carrier core compared to the regions that correspond to the projections of the surface of the carrier core. In the carrier according to the present embodiment, therefore, the regions of the surface of each carrier particle in which triboelectric charging between the carrier and the toner preferentially occurs tend to collect charges.

As long as charges are readily collected in the regions of the surface of each carrier particle in which triboelectric charging between the carrier and the toner preferentially occurs, the toner can be charged to a desired level even in a situation in which the carrier is used over a long period of time. Thus, excessive charging can be prevented even in a situation in which the carrier is used over a long period of time, preventing reduction in developing properties. The carrier is used over a long period of time for example when printing is continuously performed on successive sheets without replacing the carrier.

The carrier according to the present embodiment is produced as described above. Therefore, the regions of the surface of each carrier particle that correspond to the projections of the surface of the carrier core thereof tend to be projected compared to the regions that correspond to the recesses in the surface of the carrier core. In the case of image formation using a two-component developer containing the carrier according to the present embodiment, therefore, the regions of the surface of each carrier particle that correspond to the projections of the surface of the carrier core thereof tend to come in contact with a member (for example, an image bearing member) of an image forming apparatus compared to the regions that correspond to the recesses in the surface of the carrier core.

In the carrier according to the present embodiment, the electric resistance of the coat layer (specifically, the first coat layer) covering the regions of the surface of each carrier particle that correspond to the projections of the surface of the carrier core thereof is higher than that of the coat layer covering the regions that correspond to the recesses in the surface of the carrier core. As described above, the regions of the surface of each carrier particle in the carrier according to the present embodiment that correspond to the projections of the surface of the carrier core thereof tend to come in contact with the image bearing member compared to the regions that correspond to the recesses in the surface of the carrier core. In the carrier according to the present embodiment, therefore, it is possible to increase electric resistance in the regions of the surface of each carrier particle that tend to come in contact with the image bearing member. Thus, it is possible to prevent charge transfer from the image bearing member to the carrier (referred to below as "charge leak") via contact points between the carrier and the image bearing member even when the carrier is used over a long period of time. Thus, occurrence of fogging in a resultant image can be prevented by using a two-component developer containing the carrier according to the present embodiment in image formation. Furthermore, occurrence of carrier development can be prevented.

It is contemplated to form a carrier by sequentially layering two or more resin layers each having a different electric resistance onto a surface of each carrier core. Such a carrier is referred to below as a "reference example carrier". The reference example carrier includes carrier particles each including a carrier core, a first resin layer entirely covering a surface of the carrier core, and a second resin layer entirely covering a surface of the first resin layer.

Accordingly, the outer surface of the reference example carrier is formed only of a layer having a higher electric resistance or a layer having a lower electric resistance. Physical properties of the outer surface of the carrier typically tend to have influence on properties of the carrier. It is therefore difficult to prevent all of occurrence of fogging, occurrence of carrier development, and reduction in developing properties with respect to the reference example carrier.

In contrast, the carrier according to the present embodiment includes carrier particles including a carrier core, the first coat layer entirely covering the surface of the carrier core, and the second coat layer selectively covering the regions of the surface of the first coat layer that correspond to the recesses in the surface of the carrier core. The second coat layer has a lower electric resistance than the first coat layer. Thus, the outer surface of the carrier is prevented from being formed only of a layer having a higher electric resistance. At the same time, the outer surface of the carrier is prevented from being formed only of a layer having a lower electric resistance. It is therefore possible to prevent all of occurrence of fogging, occurrence of carrier development, and reduction in developing properties even in a situation in which the carrier is used over a long period of time.

In the carrier according to the present embodiment, the first titanium oxide content of the first coat layer is lower than the second titanium oxide content of the second coat layer. The second coat layer therefore has a lower electric resistance than the first coat layer.

More specifically, the first coat layer contains the first titanium oxide in an amount of at least 0 parts by mass and no greater than 2 parts by mass relative to 100 parts by mass of the first resin, and the second coat layer contains the second titanium oxide in an amount of at least 4 parts by mass and no greater than 10 parts by mass relative to 100 parts by mass of the second resin. The electric resistance of the first coat layer can be effectively increased by setting the amount of the first titanium oxide in the first coat layer to no greater than 2 parts by mass relative to 100 parts by mass of the first resin. Thus, the electric resistance of the first coat layer can be effectively increased to be higher than the electric resistance of the second coat layer. Consequently, it is possible to effectively prevent both occurrence of fogging and occurrence of carrier development even in a situation in which the carrier is used over a long period of time.

The electric resistance of the second coat layer can be effectively restricted to a low level by setting the amount of the second titanium oxide in the second coat layer to at least 4 parts by mass relative to 100 parts by mass of the second resin. Thus, the electric resistance of the second coat layer can be effectively restricted to be lower than the electric resistance of the first coat layer. Consequently, it is possible to effectively prevent reduction in developing properties even in a situation in which the carrier is used over a long period of time.

The second titanium oxide content of the second coat layer can be prevented from being too high by setting the amount of the second titanium oxide in the second coat layer to no greater than 10 parts by mass relative to 100 parts by mass of the second resin. Thus, charge leak can be effectively prevented. Consequently, it is possible to effectively prevent occurrence of fogging even in a situation in which the carrier is used over a long period of time.

Preferably, an arithmetic mean roughness (specifically, an arithmetic mean roughness Ra according to Japanese Industrial Standard (JIS) B0601-2013) of the surfaces of the carrier cores of the carrier according to the present embodiment is at least 0.3 μm and no greater than 2.0 μm. Thus, it is possible to effectively ensure adhesion between the carrier cores and the first coat layers even in a situation in which the carrier is used over a long period of time. Consequently, it is possible to effectively prevent occurrence of fogging, occurrence of carrier development, and reduction in developing properties even in a situation in which the carrier is used over a long period of time.

[Examples of Use of Carrier]

The carrier according to the present embodiment positively charges a toner by friction therewith. The following describes an example of a composition of a two-component developer containing the carrier according to the present embodiment with reference to FIG. 1. FIG. 1 is a diagram illustrating an example of the composition of the two-component developer according to the present embodiment. The two-component developer illustrated in FIG. 1 includes toner particles 30 and carrier particles 40.

Each of the toner particles 30 includes a toner mother particle 31 and external additive particles 32. The external additive particles 32 adhere to the surface of the toner mother particle 31. The external additive particles 32 may be inorganic particles (for example, silica particles) or resin particles.

Each of the carrier particles 40 includes a carrier core 41, a first coat layer 42, and a second coat layer 43. The carrier core 41 has recesses in a surface thereof. The first coat layer 42 and the second coat layer 43 are in a multi-layer structure in which the first coat layer 42 and the second coat layer 43 cover the surface of the carrier core 41 in the stated order. Specifically, the first coat layer 42 entirely covers the surface of the carrier core 41. The second coat layer 43 selectively covers regions of a surface of the first coat layer 42 that correspond to the recesses in the surface of the carrier core 41. The first coat layer 42 contains a first resin. The second coat layer 43 contains a second resin.

The second coat layer 43 has a lower electric resistance than the first coat layer 42. More specifically; at least the second coat layer 43, among the first and second coat layers 42 and 43, contains titanium oxide. The first titanium oxide content of the first coat layer 42 is lower than the second titanium oxide content of the second coat layer 43. The first coat layer 42 contains the first titanium oxide in an amount of at least 0 parts by mass and no greater than 2 parts by mass relative to 100 parts by mass of the first resin. The second coat layer 43 contains the second titanium oxide in an amount of at least 4 parts by mass and no greater than 10 parts by mass relative to 100 parts by mass of the second resin.

[Preferable Carrier Production Method]

Figure 2A:
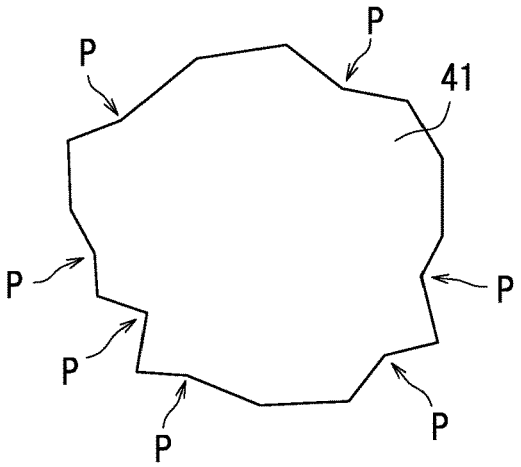
FIGS. 2A to 2C are diagrams sequentially illustrating steps of an example of a production method of the electrostatic latent image developing carrier according to the embodiment of the present disclosure.
Figure 2B:
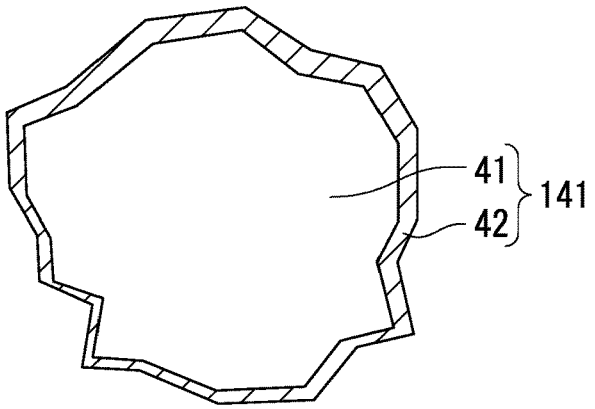
Figure 2C:
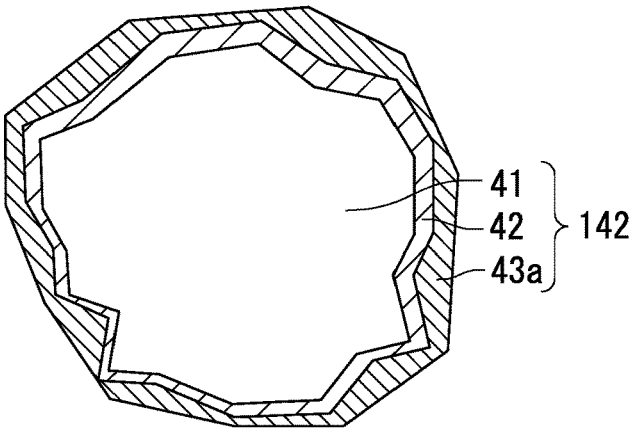

The following describes an example of a production method of the carrier according to the present embodiment with reference to FIGS. 2A to 2C. FIGS. 2A to 2C are diagrams sequentially illustrating steps of the example of the production method of the carrier according to the present embodiment. The carrier production method illustrated in FIGS. 2A to 2C is a method for producing the carrier particles 40 and includes a carrier core preparation step, a first coating step, a second coating step, and a stirring step. The carrier particles 40 produced at the same time are thought to have the same structure.

<Carrier Core Preparation Step>

The carrier cores 41 illustrated in FIG. 2A are prepared. Each of the carrier cores 41 has a plurality of recesses P The surfaces of the carrier cores 41 therefore have projections and recesses. Preferably, carrier cores having an arithmetic mean surface roughness of at least 0.3 μm and no greater than 2.0 μm are prepared as the carrier cores 41.

<First Coating Step>

As illustrated in FIG. 2B, the surface of each carrier core 41 having projections and recesses is covered with the first coat layer 42 containing the first resin. Through this step, the first coat layer 42 entirely convers the surface of the carrier core 41. That is, a coverage ratio of the surface of the carrier core 41 by the first coat layer 42 is 100%. The carrier core 41 having a surface entirely covered with the first coat layer 42 is referred to below as a "first coated core 141".

Specifically, a first coating liquid is prepared first. Preferably, the first coating liquid contains the first titanium oxide in an amount of at least 0 parts by mass and no greater than 2 parts by mass relative to 100 parts by mass of the first resin. More specifically, the first coating liquid is prepared by dispersing or dissolving the first resin in a first solvent. The above yields the first coating liquid containing no first titanium oxide. That is, the amount of the first titanium oxide in the first coat layer is 0 parts by mass relative to 100 parts by mass of the first resin. The first coating liquid may be prepared by dispersing or dissolving the first resin in the first solvent and dispersing the first titanium oxide in the first solvent. The above yields the first coating liquid containing the first titanium oxide in an amount of greater than 0 parts by mass and no greater than 2 parts by mass relative to 100 parts by mass of the first resin. That is, the amount of the first titanium oxide in the first coat layer is greater than 0 parts by mass and no greater than 2 parts by mass relative to 100 parts by mass of the first resin. The first solvent may for example be methyl ethyl ketone, tetrahydrofuran (THF), or a liquid mixture of methyl ethyl ketone and THF.

Next, the first coating liquid is applied to the surfaces of the carrier cores 41. To do so, the carrier cores 41 may be immersed in the first coating liquid, or the first coating liquid may be sprayed to the carrier cores 41 in a fluidized bed. After the first coating liquid is attached to the surfaces of the carrier cores 41, heating is performed on the carrier cores 41 being fluidized at a specified temperature for a specific period of time. Thus, the first coating liquid is hardened to form the first coat layers 42 respectively covering the surfaces of the carrier cores 41. That is, the first coated cores 141 are formed. Heating is preferably performed at a specific temperature selected from a range of from 200° C. to 300° C. for a specific period of time selected from a range of from 30 minutes to 90 minutes.

<Second Coating Step>

As illustrated in FIG. 2C, the surface of each first coat layer 42 is covered with the second coat layer 43*a* containing the second resin. Through this step, the second coat layer 43*a* entirely convers the surface of the first coat layer 42. That is, a coverage ratio of the surface of the first coat layer 42 by the second coat layer 43*a* is 100%. The carrier core 41 in which the surface of the first coat layer 42 is entirely covered with the second coat layer 43*a* is referred to below as a "second coated core 142". That is, in the second coated core 142, the first coat layer 42 entirely covers the surface of the carrier core 41 and the second coat layer 43*a* entirely covers the surface of the first coat layer 42.

Specifically, a second coating liquid is prepared first. Preferably, the second coating liquid contains the second titanium oxide in an amount of at least 4 parts by mass and no greater than 10 parts by mass relative to 100 parts by mass of the second resin. More specifically, the second coating liquid is prepared by dispersing or dissolving the second resin in a second solvent and dispersing the second titanium oxide in the second solvent. The above yields the second coating liquid containing the second titanium oxide in an amount of at least 4 parts by mass and no greater than 10 parts by mass relative to 100 parts by mass of the second resin. That is, the amount of the second titanium oxide in the second coat layer is at least 4 parts by mass and no greater than 10 parts by mass relative to 100 parts by mass of the second resin. The second solvent may for example be methyl ethyl ketone, tetrahydrofuran (THF), or a liquid mixture of methyl ethyl ketone and THF. The first solvent and the second solvent may be the same as or different from each other.

Next, the second coating liquid is applied to the surfaces of the first coated cores 141 (more specifically, to the surfaces of the first coat layers 42). To do so, the first coated cores 141 may be immersed in the second coating liquid, or the second coating liquid may be sprayed to the first coated cores 141 in a fluidized bed. After the second coating liquid is attached to the surfaces of the first coated cores 141, heating is performed on the first coated cores 141 being fluidized at a specified temperature for a specific period of time. Through the above, the second coating liquid is hardened to form the second coat layers 43*a* respectively covering the surfaces of the first coated cores 141. That is, the second coated cores 142 are formed. Heating is preferably performed at a specific temperature selected from a range of from 200° C. to 300° C. for a specific period of time selected from a range of from 30 minutes to 90 minutes.

<Stirring Step>

The second coated cores 142 illustrated in FIG. 2C are stirred. Specifically, the second coated cores 142 are stirred using a mixer. The second coated cores 142 are subjected to physical shocks through the stirring. More specifically, the second coated cores 142 collide with one another at the regions of the surfaces the second coat layers 43*a* that correspond to the projections of the surface of the carrier cores 41. As a result, the regions of the surfaces of the second coat layers 43*a* that correspond to the projections of the surfaces of the carrier cores 41 are preferentially scraped off to readily expose the first coat layers 42. Thus, the carrier including the carrier particles 40 is obtained. The surfaces of the carrier particles 40 therefore tend to have projections and recesses corresponding to the projections and recesses in the surfaces of the carrier cores 41. Furthermore, the first coat layer 42 resides preferentially in the regions of the surface of each carrier particle 40 that correspond to the projections of the surface of the carrier core 41, and the second coat layer 43 resides preferentially in the regions that correspond to the recesses P in the surface of the carrier core 41.

Carrier cores having an arithmetic mean surface roughness of at least 0.3 μm and no greater than 2.0 μm may be prepared in the carrier core preparation step described above. In a situation in which the second coated cores 142 resulting from such carrier cores are stirred, the second coat layers 43*a* are likely to remain in the regions of the surfaces of the first coat layers 42 that correspond to the recesses P in the surfaces of the carrier cores 41. Thus, the use of carrier cores having an arithmetic mean surface roughness of at least 0.3 μm and no greater than 2.0 μm facilitates production of the carrier including the carrier particles 40.

The mixer that can be used for stirring the second coated cores 142 is for example an FM mixer (product of Nippon Coke & Engineering Co., Ltd.). The FM mixer includes a mixing vessel equipped with a temperature control jacket. The FM mixer further includes, in the mixing vessel, a deflector, a temperature sensor, an upper screw, and a lower screw. A material (specific examples include particles and slurries) loaded into the mixing vessel of the FM mixer is mixed through the material being fluidized in an up-down direction while turning with rotation of the lower screw in the mixing vessel. As a result, a convective flow of the material is generated in the mixing vessel. The upper screw rotates at a high speed to apply shear force to the material. The FM mixer is capable of mixing the material with strong mixing force by applying the shear force to the material.

Preferably, the stirring time of the second coated cores 142 is determined by using a test carrier produced according to the above-described carrier production method. Specifically, first, colorants each having a different color and in a small amount are respectively added into the first and second coating liquids. Thus, a test first coating liquid and a test second coating liquid are prepared. Next, according to the above-described carrier production method, the "test first coating liquid" and the "test second coating liquid" are respectively used as the "first coating liquid" and the "second coating liquid" to form a test first coat layer and a test second coat layer on the surface of each carrier core in the stated order. Thus, carrier cores each having the test first coat layer and the test second coat layer formed in the stated order on the surface thereof (referred to below as "test carrier cores") are obtained. Subsequently, the test carrier cores are stirred. The test carrier cores are stirred while being observed using a scanning electron microscope equipped with an energy dispersive X-ray spectrometer (EDX). A time point when the test first coat layers become exposed at the regions of the surfaces of the test second coat layers that correspond to the projections of the surfaces of the carrier cores are determined to be the end of the stirring. Then, a period of time from the start of the stirring to the end of the stirring is determined to be the stirring time. The stirring time is preferably determined as described above.

Whether or not the produced carrier includes desired carrier particles can be confirmed by observing the carrier particles using a scanning electron microscope equipped with an EDX. Specifically, some carrier particles are embedded in an ultraviolet curable resin. Next, the ultraviolet curable resin having the carrier particles embedded therein is processed using CROSS SECTION POLISHER (registered Japanese trademark, CP). As a result, some of the carrier particles embedded in the ultraviolet curable resin are cut. The cut surfaces of the carrier particles are observed using a scanning electron microscope equipped with an EDX. It is assumed that the produced carrier includes desired carrier particles if the following points X and Y are confirmed.

X: The entire surface of each carrier core has a coat layer.

Y: The regions of the surface of each carrier particle that correspond to the recesses in the surface of the carrier core thereof contain a greater amount of titanium (Ti) element than the regions that correspond to the projections of the surface of the carrier core. Note that the titanium (Ti) element is derived from the first titanium oxide and the second titanium oxide.

Through the above, an example of a method for producing the carrier according to the present embodiment has been described with reference to FIGS. 2A to 2C. According to the carrier production method illustrated in FIGS. 2A to 2C, the second coat layers 43*a* may be formed in the same manner as in formation of the first coat layers 42 or in a different manner from formation of the first coat layers 42.

Alternatively, the carrier according to the present embodiment may be produced according to the method described below (see Examples described below). First, the first coating liquid is applied onto the surfaces of the carrier cores 41. Next, the second coating liquid is applied onto the surfaces of the carrier cores covered with the first coating liquid. Thereafter, heating is performed. Through the above, the first coating liquid and the second coating liquid are simultaneously hardened to form the second coated cores 142.

[Examples of Materials of Carrier]

<Carrier Cores>

Preferably, the carrier cores contain a magnetic material. More specifically, the carrier cores may be particles of a magnetic material (magnetic particles). In the case of carrier cores containing a binder resin, the magnetic particles may be dispersed in the binder resin.

Examples of magnetic materials that can be preferably contained in the carrier cores include ferromagnetic metals and ferromagnetic metal oxides. Examples of preferable ferromagnetic metals include iron, cobalt, nickel, and metallic materials containing at least one of the aforementioned metals. Examples of preferable metallic materials containing at least one of iron, cobalt, and nickel include alloys or mixtures of at least one of iron, cobalt, and nickel with at least one of copper, zinc, antimony, aluminum, lead, tin, bismuth, beryllium, manganese, magnesium, selenium, tungsten, zirconium, and vanadium. Examples of ferromagnetic metal oxides include ferrite and magnetite.

The magnetic material contained in the carrier cores may be a mixture of any of the ferromagnetic metal oxides listed above with at least one of metal oxides, metal nitrides, and carbides. Examples of preferable metal oxides include iron oxide, titanium oxide, and magnesium oxide. Examples of preferable metal nitrides include chromium nitride and vanadium nitride. Examples of carbides include silicon carbide and metal carbides represented by tungsten carbide.

More preferably, the magnetic material contained in the carrier cores is a ferrite or a magnetite. Examples of preferable ferrites include magnetite (spinel ferrite), barium ferrite, Mn ferrite, Mn—Zn ferrite, Ni—Zn ferrite, Mn—Mg ferrite, Ca—Mg ferrite, Li ferrite, Cu—Zn ferrite, and Mn—Mg—Sr ferrite.

One magnetic material may be used independently, or two or more magnetic materials may be used in combination as materials of the carrier cores. Commercially available carrier cores may be used. Carrier cores may be made from scratch by pulverizing and baking a magnetic material. The saturation magnetization of the carrier can be adjusted by adjusting the amount of the magnetic material (particularly the amount of the ferromagnetic material). The roundness of the carrier can be adjusted by adjusting the temperature at which the magnetic material is baked (baking temperature).

More preferably, the carrier cores are particles of a ferrite (ferrite particles). Ferrite particles tend to be sufficiently magnetic in terms of image formation. Ferrite particles prepared according to a common method tend not to be spherical, having suitably rough surfaces. Specifically, an arithmetic mean roughness (specifically, an arithmetic mean roughness Ra according to Japanese Industrial Standard (JIS) B0601-2013) of the surfaces of ferrite particles tends to be at least 0.3 μm and no greater than 2.0 μm.

Preferably, the carrier cores have a volume median diameter ($D_{50}$) of at least 30 μm and no greater than 100 μm. Such carrier cores can provide improved developing properties. A value for volume median diameter (Do) of the carrier cores is measured using a laser diffraction/scattering particle size distribution analyzer ("LA-700", product of Horiba, Ltd.).

<First Coat Layer>

(First Resin)

Preferably, the first resin is for example one selected from the group consisting of silicone-based resins, acrylic resins, styrene-acrylic acid-based resins, polyester resins, and fluororesins.

(First Resin: Silicone-Based Resin)

A silicone-based resin has siloxane bonds "Si—O—Si" in a main chain thereof and an organic group in side chains thereof. A methyl silicone resin has only a methyl group as an organic group in side chains thereof. A methylphenyl silicone resin has a methyl group and a phenyl group as organic groups in side chains thereof. The silicone-based resin for example has a structure represented by formula (1-1) or (1-2) shown below. In formulae (1-1) and (1-2), $n_{11}$, $n_{21}$, and $n_{22}$ each represent, independently of one another, a repeating number (any number) of a corresponding repeating unit. In order that a silicone-based resin has excellent durability, the silicone-based resin preferably includes two or more main chains (siloxane bonds: Si—O—Si) that are linked in three dimensions.

(1-1)

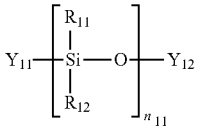

In formula (1-1), $R_{11}$ represents an organic group. More specifically, $R_{11}$ represents a methyl group or a phenyl group. $R_{12}$ represents a hydrogen atom or an organic group. More specifically. $R_{12}$ represents a hydrogen atom, a methyl group, or a phenyl group. $R_{11}$ and $R_{12}$ may be the same as or different from one another. $Y_{11}$ represents a first end, and $Y_{12}$ represents a second end. The first end for example has an organosiloxy group. More specifically, the first end has a trimethylsiloxy group. The second end for example has an organosilyl group. More specifically, the second end has a trimethylsilyl group.

(1-2)

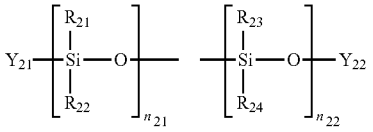

In formula (1-2), $R_{21}$, $R_{22}$, and $R_{23}$ each represent, independently of one another, an organic group. More specifically, $R_{21}$, $R_{22}$, and $R_{23}$ each represent, independently of one another, a methyl group or a phenyl group. $R_{24}$ represents a hydrogen atom or an organic group. More specifically, $R_{24}$ represents a hydrogen atom, a methyl group, or a phenyl group. $Y_{21}$ represents a first end, and $Y_{22}$ represents a second end. The first end for example has an organosiloxy group. More specifically, the first end has a trimethylsiloxy group. The second end for example has an organosilyl group. More specifically, the second end has a trimethylsilyl group.

(First Resin: Acrylic Resin)

An acrylic resin is a polymer of at least one acrylic acid-based monomer. Acrylic acid-based monomers listed below can for example be preferably used to synthesize the acrylic resin.

Examples of preferable acrylic acid-based monomers include (meth)acrylic acid, (meth)acrylonitrile, alkyl (meth) acrylates, and hydroxyalkyl (meth)acrylates. Examples of preferable alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth) acrylate, and 2-ethylhexyl (meth)acrylate. Examples of preferable hydroxyalkyl (meth)acrylates include 2-hydroxyethyl (meth)acrylate, 3-hydroxypropyl (meth)acrylate, 2-hydroxypropyl (meth)acrylate, and 4-hydroxybutyl (meth) acrylate.

(First Resin: Styrene-Acrylic Acid-based Resin)

A styrene-acrylic acid-based resin is a copolymer of at least one styrene-based monomer and at least one acrylic acid-based monomer. Styrene-based monomers listed below can for example be preferably used to synthesize the styrene-acrylic acid-based resin. The acrylic acid-based monomers listed above in the section of (First Resin: Acrylic Resin) can for example be preferably used to synthesize the styrene-acrylic acid-based resin.

Examples of preferable styrene-based monomers include styrene, alkylstyrenes, p-hydroxystyrene, m-hydroxystyrene, vinyltoluene, α-chlorostyrene, o-chlorostyrene, m-chlorostyrene, and p-chlorostyrene. Examples of preferable alkylstyrenes include α-methylstyrene, p-ethylstyrene, and 4-tert-butylstyrene.

(First Resin: Polyester Resin)

A polyester resin is a copolymer of at least one alcohol and at least one carboxylic acid. Di-, tri-, or higher-hydric alcohols listed below can for example be used to synthesize the polyester resin. Examples of di-hydric alcohols that can be used include diols and bisphenols. Di-, tri-, or higher-basic carboxylic acids listed below can for example be used to synthesize the polyester resin.

Examples of preferable diols include aliphatic diols. Examples of preferable aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Examples of preferable α,ω-alkanediols include ethylene glycol, 1,3-propanediol, 1,4-butanediol, 1,5-pentanediol, 1,6-hexanediol, 1,7-heptanediole, 1,8-octanediol, 1,9-nonanediol, and 1,12-dodecanediol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids include aromatic dicarboxylic acids. α,ω-alkanedicarboxylic acids, unsaturated dicarboxylic acids, and cycloalkane dicarboxylic acids. Examples of preferable aromatic dicarboxylic acids include phthalic acid, terephthalic acid, and isophthalic acid. Examples of preferable α,ω-alkanediols include malonic acid, succinic acid, adipic acid, suberic acid, azelaic acid, sebacic acid, and 1,10-decanedicarboxylic acid. Examples of preferable unsaturated dicarboxylic acids include maleic acid, fumaric acid, citraconic acid, itaconic acid, and glutaconic acid. Examples of preferable cycloalkane dicarboxylic acids include cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxyli c acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(First Resin: Fluororesin)

Examples of preferable fluororesins include polyvinyl fluoride, polyvinylidene fluoride, polytetrafluoroethylene (PTFE), polytrifluoroethylene, polyhexafluoropropylene, tetrafluoroethylene-hexafluoropropylene copolymer (FEP), and tetrafluoroethylene-perfluoroalkylvinylether copolymer (PFA). Preferably, the polytrifluoroethylene is for example polychlorotrifluoroethylene.

(First Resin: Amount)

Preferably, the first coat layers contain the first resin in an amount of at least 0.3 parts by mass and no greater than 5.0 parts by mass relative to 100 parts by mass of the carrier cores. As a result of the first coat layers containing the first resin in an amount of at least 0.3 parts by mass relative to 100 parts by mass of the carrier cores, occurrence of carrier development can be effectively prevented. As a result of the first coat layers containing the first resin in an amount of no greater than 5.0 parts by mass relative to 100 parts by mass of the carrier cores, occurrence of excessive charging can be effectively prevented. It is therefore possible to achieve improved developing properties. More preferably, the first coat layers contain the first resin in an amount of at least 0.5 parts by mass and no greater than 3.0 parts by mass relative to 100 parts by mass of the carrier cores.

(First Titanium Oxide)

Preferably, the first titanium oxide is conductive titanium oxide. More preferably, the first titanium oxide includes first conductive particles. More specifically, each of the first conductive particles preferably includes a substrate formed of titanium oxide and a cover layer. The titanium oxide forming the substrate may have an anatase, rutile, or brookite crystal structure. The substrate may be a mixture of titanium oxides in different crystal structures. Preferably, the substrate has a spherical profile. The cover layer covers at least a portion of a surface of the substrate. Preferably, the cover layer contains an oxide of a metal element that is not a titanium element. For example, the cover layer preferably contains tin oxide ($SnO_2$). Specifically, the cover layer is preferably a film of tin oxide doped with antimony (Sb).

The first conductive particles may be formed of titanium oxide doped with an element that is not a titanium element or an oxygen element. Examples of non-titanium or non-oxygen elements include a niobium (Nb) element and a tantalum (Ta) element. The titanium oxide doped with a non-titanium or non-oxygen element may have an anatase, rutile, or brookite crystal structure.

Commercially available conductive titanium oxide particles may be used as the first conductive particles. Examples of commercially available conductive titanium oxide particles include "EC-100", "EC-210", and "EC-300E", which are produced by Titan Kogyo, Ltd. Each of "EC-100", "EC-210", and "EC-300E" produced by Titan Kogyo, Ltd. includes particles of titanium oxide and cover layers respectively covering surfaces of the particles of titanium oxide. Each cover layer covers at least a portion of the corresponding particle of titanium oxide. Each cover layer is a film of tin oxide doped with antimony.

<Second Coat Layer>

(Second Resin)

The resins listed above as specific examples of the first resin in the section of <First Coat Layer> can be preferably used as the second resin. The second resin may be different from the first resin. However, the second resin is preferably the same as the first resin. The second coating liquid can be heated under the same conditions as in heating of the first coating liquid as long as the second resin is the same as the first resin. This facilitates production of the carrier according to the present embodiment.

(Second Resin: Amount)

Preferably, the second coat layers contain the second resin in an amount of at least 0.3 parts by mass and no greater than 5.0 parts by mass relative to 100 parts by mass of the carrier cores. As a result of the second coat layers containing the second resin in an amount of no greater than 0.3 parts by mass relative to 100 parts by mass of the carrier cores, occurrence of excessive charging can be effectively prevented. It is therefore possible to achieve improved developing properties. As a result of the second coat layers containing the second resin in an amount of no greater than 5.0 parts by mass relative to 100 parts by mass of the carrier cores, occurrence of charge leak can be effectively prevented. Consequently, occurrence of fogging can be effectively prevented. More preferably, the second coat layers contain the second resin in an amount of at least 0.5 parts by mass and no greater than 3.0 parts by mass relative to 100 parts by mass of the carrier cores.

(Second Titanium Oxide)

Preferably, the second titanium oxide is conductive titanium oxide. More preferably, the second titanium oxide includes second conductive particles. Still more preferably, the second titanium oxide is a powder of the second conductive particles. The conductive particles listed above as specific examples of the first conductive particles in the section of (First Titanium Oxide) can be preferably used as the second conductive particles. Preferably, the second conductive particles are the same as the first conductive particles. As a result, the second titanium oxide naturally has the same physical properties as the first titanium oxide. For example, the second titanium oxide naturally has the same electric resistance as the first titanium oxide. Accordingly, the second coat layers can have a lower electric resistance than the first coat layers through the second titanium oxide content of the second coat layers being lower than the first titanium oxide content of the first coat layers. The "second titanium oxide having the same electric resistance as the first titanium oxide" means that a bulk of the second titanium oxide has the same electric resistance as a bulk of the first titanium oxide. For example, it means that the electric resistance of a bulk of the second titanium oxide is at least 90% and no greater than 1100% of the electric resistance of a bulk of the first titanium oxide.

EXAMPLES

The following describes Examples of the present disclosure. Table 1 shows carriers (electrostatic latent image developing carriers) C-1 to C-10 according to Examples or Comparative Examples. In Table 1, "First layer" means the first coat layers, and "Second layer" means the second coat layers. The column titled "Stirring" shows whether or not the stirring step was performed. In this column, examples with the stirring step are described as "Yes", and examples without the stirring step are described as "No". The carriers C-1 to C-8 each had a multi-layer coat layer structure. In contrast, the carriers C-9 and C-10 each had a single-layer coat layer structure.

TABLE 1

| Carrier | | | | | | | |
|---|---|---|---|---|---|---|---|
| | Coat layer | | | | | | |
| | Titanium oxide amount (parts by mass) | | | Resin material | | | |
| | Two layers | | | Two layers | | | |
| Type | First layer | Second layer | Single layer | First layer | Second layer | Single layer | Stirring |
| C-1 | 0 | 4 | — | Fluororesin | | — | Yes |
| C-2 | 0 | 10 | — | Fluororesin | | — | Yes |
| C-3 | 2 | 4 | — | Fluororesin | | — | Yes |
| C-4 | 2 | 10 | — | Fluororesin | | — | Yes |
| C-5 | 0 | 4 | — | Silicone-based resin | | — | Yes |
| C-6 | 2 | 10 | — | Silicone-based resin | | — | Yes |
| C-7 | 0 | 10 | — | Fluororesin | | — | No |
| C-8 | 10 | 2 | — | Fluororesin | | — | Yes |
| C-9 | — | — | 2 | — | | Fluororesin | No |
| C-10 | — | — | 10 | — | | Fluororesin | No |

The following describes a production method, evaluation methods, and evaluation results of the carriers C-1 to C-10 in the stated order. In evaluations in which errors might occur, an evaluation value was calculated by obtaining an appropriate number of measured values and calculating the arithmetic mean of the measured values in order to ensure that any errors were sufficiently small.

[Carrier Production Method]

<Production Method of Carrier C-1>

A first coating liquid and a second coating liquid were applied onto surfaces of carrier cores in the stated order. Thereafter, heating was performed. The resultant second coated cores were stirred. Through the above, a carrier (carrier C-1) including a number of carrier particles was obtained. The following describes the production method in detail.

(Carrier Core Preparation)

A ball mill was used to pulverize 40 parts by mass of MnO, 9 parts by mass of MgO, 50 parts by mass of $Fe_2O_3$, and 1 part by mass of SrO over 2 hours. The resultant pulverized product was baked at 1,000° C. for 5 hours. Through the above, carrier cores formed from manganese-containing ferrite (Mn—Mg—Sr ferrite) were obtained. The resultant carrier cores had a volume median diameter ($D_{50}$) of 40 μm and a saturation magnetization of 65 $Am^2/kg$ in response to application of a magnetic field at 3,000 ($10^3/4\pi \cdot A/m$).

(First Coating)

Methyl ethyl ketone and an FEP resin solution were mixed to give the first coating liquid. Thereafter, the carrier cores obtained as described above were loaded into a flow coating apparatus. The first coating liquid was sprayed onto the carrier cores being fluidized. The amount of the first coating liquid was adjusted so as to give an FEP amount of 2 parts by mass relative to 100 parts by mass of the carrier cores. Through the above, the surfaces of the carrier cores were entirely coated with the first coating liquid (coverage ratio 100%). As described above, carrier cores each having a surface coated with the first coating liquid (referred to below as "third coated cores") were obtained.

(Second Coating)

Methyl ethyl ketone, an FEP resin solution, and conductive titanium oxide particles ("EC-100", product of Titan Kogyo, Ltd.) were mixed to give the second coating liquid. The resultant second coating liquid contained 4 parts by mass of titanium oxide relative to 100 parts by mass of the FEP resin solution. Thereafter, the third coated cores were loaded into a flow coating apparatus. The second coating liquid was sprayed onto the third coated cores being fluidized. The amount of the second coating liquid was adjusted so as to give an FEP amount of 2 parts by mass relative to 100 parts by mass of the carrier cores. Through the above, the surfaces of the third coated cores were entirely coated with the second coating liquid (coverage ratio 100%).

(Heating)

The fluidized bed in the flow coating apparatus was heated at 280° C. over an hour to harden (resinify) the first coating liquid and the second coating liquid. Thus, second coated cores were obtained. The first coat layers contained an FEP (first resin: fluororesin). The second coat layers contained an FEP (second resin: fluororesin) and titanium oxide.

(Stirring)

The second coated cores (particles) obtained as described above were loaded into an FM mixer ("FM-10B", product of Nippon Coke & Engineering Co., Ltd.). The FM mixer was used to stir the second coated cores under conditions of a stirring speed of 1,200 rpm and a stirring time of 10 minutes. Through the stirring, regions of the surface of each second coated core that corresponded to projections of the surface of the carrier core were scraped off to expose the first coat layer. As a result, the carrier (carrier C-1) including a number of carrier particles was obtained.

<Production Method of Carrier C-2>

The amount of titanium oxide in the second coating liquid was changed to 10 parts by mass relative to 100 parts by mass of the FEP resin solution. Other than that, the carrier C-2 was produced according to the same method as the production method of the carrier C-1.

<Production Method of Carrier C-3>

Methyl ethyl ketone, an FEP resin solution, and conductive titanium oxide particles ("EC-100", product of Titan Kogyo, Ltd.) were mixed to give the first coating liquid. The resultant first coating liquid contained 2 parts by mass of titanium oxide relative to 100 parts by mass of the FEP resin solution. Other than that, the carrier C-3 was produced according to the same method as the production method of the carrier C-1.

<Production Method of Carrier C-4>

The first coating liquid used in the production of the carrier C-3 was used. The second coating liquid used in the production of the carrier C-2 was used. Other than that, the carrier C-4 was produced according to the same method as the production method of the carrier C-1.

<Production Method of Carrier C-5>

A thermosetting silicone resin solution ("SR2400", product of Dow Corning Toray Co., Ltd., resin: methyl silicone resin, solvent: toluene, nonvolatile content: 50% by mass) was used instead of the FEP resin solution to prepare both the first coating liquid and the second coating liquid. Other than that, the carrier C-5 was produced according to the same method as the production method of the carrier C-1.

<Production Method of Carrier C-6>

A thermosetting silicone resin solution ("SR2400", product of Dow Corning Toray Co., Ltd., resin: methyl silicone resin, solvent: toluene, nonvolatile content: 50% by mass) was used instead of the FEP resin solution to prepare both the first coating liquid and the second coating liquid. Other than that, the carrier C-6 was produced according to the same method as the production method of the carrier C-4.

<Production Method of Carrier C-7>

The second coated cores were not stirred. Other than that, the carrier C-7 was produced according to the same method as the production method of the carrier C-2.

<Production Method of Carrier C-8>

The second coating liquid was sprayed to the carrier cores, and subsequently the first coating liquid was sprayed to the carrier cores. Other than that, the carrier C-8 was produced according to the same method as the production method of the carrier C-4.

<Production Method of Carrier C-9>

The second coating liquid was not sprayed to the third coated cores. The first coating liquid was sprayed to the carrier cores and hardened to form only the first coat layers on the surfaces of the carrier cores. Thereafter, however, the carrier cores were not stirred. Other than that, the carrier C-9 was produced according to the same method as the production method of the carrier C-3.

<Production Method of Carrier C-10>

The second coating liquid was sprayed to the carrier cores, but the first coating liquid was not sprayed to the carrier cores. The second coating liquid was hardened to form only the second coat layers on the surfaces of the carrier cores. Thereafter, however, the carrier cores were not stirred. Other than that, the carrier C-10 was produced according to the same method as the production method of the carrier C-2.

[Carrier Evaluation Methods]

An evaluation apparatus was prepared according to the method describe below. The evaluation apparatus was used to evaluate each carrier (more specifically, each of the carriers C-1 to C-10).

<Evaluation Apparatus Preparation Method>

(Toner Production Method)

First, 100 parts by mass of a polyester resin ("XPE258", product of Mitsui Chemicals, Inc.), 5 parts by mass of a polypropylene wax ("VISCOL (registered Japanese trademark) 660P", product of Sanyo Chemical Industries, Ltd.), 5 parts by mass of a colorant ("REGAL (registered Japanese trademark) 330R", product of Cabot Corporation), and 1 part by mass of a quaternary ammonium salt ("BONTRON (registered Japanese trademark) P-51), product of ORIENT CHEMICAL INDUSTRIES, Co., Ltd.) were mixed using an FM mixer ("FM-10B", product of Nippon Coke & Engineering Co., Ltd.). The resultant mixture was melt-kneaded using a twin screw extruder ("PCM-30", product of Ikegai Corp.). The resultant kneaded product was cooled, and then pulverized using a pulverizer ("Turbo Mill", product of FREUND-TURBO CORPORATION). The resultant pulverized product was classified using a classifier ("Elbow Jet model EJ-LABO", product of Nittetsu Mining Co., Ltd.). As a result, toner mother particles having a volume median diameter ($D_{50}$) of 7 μm were obtained.

Next, 100.0 parts by mass of the toner mother particles (toner mother particles obtained as described above), 1.0 part by mass of conductive titanium oxide particles ("EC-100", product of Titan Kogyo, Ltd.), and 0.7 parts by mass of hydrophobic silica particles ("AEROSIL (registered Japanese trademark) RA-200H", product of Nippon Aerosil Co., Ltd.) were mixed using an FM mixer ("FM-10B", product of Nippon Coke & Engineering Co., Ltd.) under conditions of a stirring speed of 3,500 rpm and a stirring time of 5 minutes. Through the above, the conductive titanium oxide particles and the hydrophobic silica particles were caused to adhere to surfaces of the toner mother particles. As a result, a toner T-1 including a number of toner particles was obtained.

(Two-component Developer Production Method)

With respect to each of the carriers C1 to C10, the carrier and the toner T-1 were mixed for 1 hour using a powder mixer ("ROCKING MIXER (registered Japanese trademark)", product of AICHI ELECTRIC CO., LTD., mixing method: container rotating and rocking method). For the mixing, the amount of the carrier and the amount of the toner T-1 were adjusted such that the toner T-1 accounts for 10% by mass of a resultant two-component developer. Through the above, the two-component developer was obtained.

(Two-Component Developer Loading)

The two-component developer produced as described above was loaded into a container section of a developing device of a multifunction peripheral ("TASKalfa 500ci", product of KYOCERA Document Solutions Inc.). The toner T-1 was loaded into a toner container of the multifunction peripheral. Thus, the evaluation apparatus was prepared.

<Image Density and Fogging Density Evaluation Method>

First, the evaluation apparatus was used to print a first evaluation sample image under environmental conditions of a temperature of 20° C. and a relative humidity of 50%. The first evaluation sample image included a solid image portion and a blank paper portion (region not printed on). Thereafter, an image density (ID) and a fogging density (FD) of the first evaluation sample image were separately measured. Thus, an initial image density (ID) and an initial fogging density (FD) were determined.

Next, the evaluation apparatus was used to perform a 1% printing durability test under environmental conditions of a temperature of 20° C. and a relative humidity of 50%. An image having a coverage of 1% was printed on 10,000 successive sheets of printing paper (A4 size paper) in the 1% printing durability test. Thereafter, the evaluation apparatus was used to print a second evaluation sample image. The second evaluation sample image included a solid image portion and a blank paper portion. Thereafter, an image density (ID) and a fogging density (FD) of the second evaluation sample image were separately measured. Thus, a post-1% printing image density (ID) and a post-1% printing fogging density (FD) were determined.

Next, the evaluation apparatus was used to perform a 5% printing durability test under environmental conditions of a temperature of 20° C. and a relative humidity of 50%. An image having a coverage of 5% was printed on 100,000 successive sheets of printing paper (A4 size paper) in the 5% printing durability test. Thereafter, the evaluation apparatus was used to print a third evaluation sample image. The third evaluation sample image included a solid image portion and a blank paper portion. Thereafter, an image density (ID) and a fogging density (FD) of the third evaluation sample image were separately measured. Thus, a post-5% printing image density (ID) and a post-5% printing fogging density (FD) were determined.

In the image density (ID) measurement, a reflection density (ID: image density) of the solid image portion of each of the first to third evaluation sample images was measured using a Macbeth reflection densitometer ("RD914", product of X-Rite Inc.).

Results of the image density (ID) were evaluated in accordance with the following evaluation standard. Table 2 shows the results.

Excellent: An image density (ID) of 1.3 or greater

Good: An image density (ID) of 1.0 or greater and less than 1.3

Poor: An image density (ID) of less than 1.0

In the fogging density (FD) measurement, a reflection density of the blank paper portion of each of the first to third evaluation sample images was measured using a color reflectance densitometer ("R710", product of Ihara Electronic Industries Co., Ltd.). The fogging density (FD) was calculated in accordance with a formula shown below.

FD=(Reflection density of blank paper portion)−(Reflection density of unprinted paper)

Results of the fogging density (FD) were evaluated in accordance with the following evaluation standard. Table 3 shows the results.

Excellent: A fogging density (FD) of less than 0.005

Good: A fogging density (FD) of 0.005 or greater and less than 0.010

Poor: A fogging density (FD) of 0.010 or greater

<Carrier Development Evaluation Method>

A sheet of printing paper with the first evaluation sample image formed thereon was used to visually confirm the number of carrier particles adhering to the blank paper portion of the printing paper (the number of carrier particles transferred to the blank paper portion of the printing paper). Thus, an initial carrier particle count was determined.

The printing paper with the third evaluation sample image formed thereon was used to visually confirm the number of carrier particles adhering to the blank paper portion on the printing paper. Thus, a post-5% printing carrier particle count was determined.

Results of carrier development were evaluated in accordance with the following evaluation standard. Table 4 shows the results.

Excellent: A carrier particle count of 0.00/cm$^2$

Good: A carrier particle count of greater than 0.00/cm$^2$ and not greater than 0.25/cm Poor: A carrier particle count of greater than 0.25/cm$^2$

[Evaluation Results]

Table 2 shows the evaluation results of the image density. The evaluation results shown in Table 2 are values measured for the image density (ID). Table 3 shows the evaluation results of the fogging density. The evaluation results shown in Table 3 are values calculated for the fogging density (FD). Table 4 shows the evaluation results of the carrier development. The evaluation results shown in Table 4 are values measured for the carrier particle count.

TABLE 2

| | | Image density (ID) | | |
|---|---|---|---|---|
| | | Initial | Post-1% printing | Post-5% printing |
| Example 1 | C-1 | 1.39 | 1.26 | 1.19 |
| Example 2 | C-2 | 1.40 | 1.30 | 1.20 |
| Example 3 | C-3 | 1.43 | 1.31 | 1.23 |
| Example 4 | C-4 | 1.46 | 1.35 | 1.28 |
| Example 5 | C-5 | 1.37 | 1.23 | 1.16 |
| Example 6 | C-6 | 1.40 | 1.32 | 1.25 |
| Comparative Example 1 | C-7 | 1.42 | 1.33 | 1.23 |
| Comparative Example 2 | C-8 | 1.30 | 0.98 | 1.11 |
| Comparative Example 3 | C-9 | 1.27 | 0.92 | 1.09 |
| Comparative Example 4 | C-10 | 1.47 | 1.32 | 1.26 |

TABLE 3

| | | Fogging density (FD) | | |
|---|---|---|---|---|
| | | Initial | Post-1% printing | Post-5% printing |
| Example 1 | C-1 | 0.001 | 0.001 | 0.006 |
| Example 2 | C-2 | 0.003 | 0.000 | 0.005 |
| Example 3 | C-3 | 0.003 | 0.002 | 0.005 |
| Example 4 | C-4 | 0.006 | 0.003 | 0.008 |
| Example 5 | C-5 | 0.002 | 0.002 | 0.006 |
| Example 6 | C-6 | 0.005 | 0.002 | 0.008 |
| Comparative Example 1 | C-7 | 0.007 | 0.005 | 0.011 |
| Comparative Example 2 | C-8 | 0.003 | 0.002 | 0.007 |
| Comparative Example 3 | C-9 | 0.002 | 0.002 | 0.008 |
| Comparative Example 4 | C-10 | 0.008 | 0.005 | 0.012 |

TABLE 4

| | | Carrier development | |
|---|---|---|---|
| | | Initial | Post-5% printing |
| Example 1 | C-1 | 0.00 | 0.09 |
| Example 2 | C-2 | 0.00 | 0.15 |
| Example 3 | C-3 | 0.00 | 0.21 |
| Example 4 | C-4 | 0.00 | 0.19 |
| Example 5 | C-5 | 0.00 | 0.12 |
| Example 6 | C-6 | 0.00 | 0.23 |
| Comparative Example 1 | C-7 | 0.32 | 0.54 |
| Comparative Example 2 | C-8 | 0.41 | 0.63 |
| Comparative Example 3 | C-9 | 0.00 | 0.13 |
| Comparative Example 4 | C-10 | 0.38 | 0.60 |

Each of the carriers C-1 to C-6 (more specifically, carriers according to Examples 1 to 6) had the above-described basic feature. Specifically, each of the carrier C-1 to C-6 included carrier particles. Each of the carrier particles included a carrier core having recesses in the surface thereof, and the first and second coat layers covering the surface of the carrier core. The first and second coat layers were in a multi-layer structure in which the first coat layer and the second coat layer covered the surface of the carrier core in the stated order. The first coat layer entirely covered the surface of the carrier core. The second coat layer selectively covered the regions of the surface of the first coat layer that corresponded to the recesses in the surface of the carrier core. The first coat layer contained the first resin. The second coat layer contained the second resin. The second coat layer had a lower electric resistance than the first coat layer. At least the second coat layer, among the first and second coat layers, contained titanium oxide. The first titanium oxide content of the first coat layer was lower than the second titanium oxide content of the second coat layer. The amount of the first titanium oxide in the first coat layer was at least 0 parts by mass and no greater than 2 parts by mass relative to 100 parts by mass of the first resin. The amount of the second titanium oxide in the second coat layer was at least 4 parts by mass and no greater than 10 parts by mass relative to 100 parts by mass of the second resin.

As indicated in Tables 2 to 4, each of the carriers C-1 to C-6 provided a good image density after the 5% printing durability test. Each of the carriers C-1 to C-6 also prevented occurrence of fogging and carrier development after the 5% printing durability test.

In contrast, each of the carriers C-7 to C-10 (more specifically, carriers according to Comparative Examples 1 to 4) did not have the above-described basic feature. Specifically, in the production of the carrier C-7, stirring of the second coated cores was not performed. Presumably, each second coat layer in the carrier C-7 therefore covered not only the regions of the surface of the first coat layer that corresponded to the recesses in the surface of the carrier core but also the regions that corresponded to the projections of the surface of the carrier core. The carrier C-7 resulted in fogging after the 5% printing durability test. The carrier C-7 also resulted in carrier development in the initial printing.

In the production of the carrier C-8, the first coating liquid was sprayed after the second coating liquid had been sprayed to the carrier cores. Presumably, each second coat layer therefore entirely covered the surface of the carrier core in the carrier C-8. Presumably, each first coat layer therefore selectively covered the regions of the surface of the second coat layer that corresponded to the recesses in the surface of the carrier core. The carrier C-8 resulted in a reduced image density after the 1% printing durability test. The carrier C-8 also resulted in carrier development in the initial printing.

In the production of the carrier C-9, the second coating liquid was not sprayed to the third coated cores. The first coating liquid was sprayed and hardened to form only the first coat layers on the surfaces of the carrier cores. Thereafter, however, the carrier cores were not stirred. Presumably, the surface of the carrier C-9 therefore only included the higher-resistance coat layers. The carrier C-9 resulted in a reduced image density after the 1% printing durability test.

In the production of the carrier C-10, the second coating liquid was sprayed to the carrier cores, but the first coating liquid was not sprayed to the carrier cores. The second coating liquid was hardened to form only the second coat layers on the surfaces of the carrier cores. Thereafter, however, the carrier cores were not stirred. Presumably, the surface of the carrier C-10 therefore only included the lower-resistance coat layers. The carrier C-10 resulted in fogging after the 5% printing durability test. The carrier C-10 also resulted in carrier development in the initial printing.

What is claimed is:

1. An electrostatic latent image developing carrier for positively charging an electrostatic latent image developing toner by friction therewith, the electrostatic latent image developing carrier comprising carrier particles, wherein each of the carrier particles includes a carrier core having recesses in a surface thereof, and first and second coat layers covering the surface of the carrier core, the first and second coat layers are in a multi-layer structure in which the first coat layer and the second coat layer cover the surface of the carrier core in the stated order, the first coat layer entirely covers the surface of the carrier core, the second coat layer selectively covers regions of a surface of the first coat layer that correspond to the recesses in the surface of the carrier core, the first coat layer contains a first resin, the second coat layer contains a second resin, the second coat layer has a lower electric resistance than the first coat layer, at least the second coat layer, among the first and second coat layers, contains titanium oxide, the first coat layer has a lower titanium oxide content than the second coat layer, the first coat layer contains the titanium oxide in an amount of at least 0 parts by mass and no greater than 2 parts by mass relative to 100 parts by mass of the first resin, and the second coat layer contains the titanium oxide in an amount of at least 4 parts by mass and no greater than 10 parts by mass relative to 100 parts by mass of the second resin.

2. The electrostatic latent image developing carrier according to claim 1, wherein the carrier cores have an arithmetic mean surface roughness of at least 0.3 μm and no greater than 2.0 μm.

3. The electrostatic latent image developing carrier according to claim 1, wherein each of the first and second resins is one selected from the group consisting of silicone-based resins, acrylic resins, styrene-acrylic acid-based resins, polyester resins, and fluororesins.

4. The electrostatic latent image developing carrier according to claim 1, wherein the first coat layers contain the first resin in an amount of at least 0.3 parts by mass and no greater than 5.0 parts by mass relative to 100 parts by mass of the carrier cores.

5. The electrostatic latent image developing carrier according to claim 1, wherein the first coat layers contain the first resin in an amount of at least 0.5 parts by mass and no greater than 3.0 parts by mass relative to 100 parts by mass of the carrier cores.

6. The electrostatic latent image developing carrier according to claim 1, wherein the second coat layers contain the second resin in an amount of at least 0.3 parts by mass and no greater than 5.0 parts by mass relative to 100 parts by mass of the carrier cores.

7. The electrostatic latent image developing carrier according to claim 1, wherein the second coat layers contain the second resin in an amount of at least 0.5 parts by mass and no greater than 3.0 parts by mass relative to 100 parts by mass of the carrier cores.

8. The electrostatic latent image developing carrier according to claim 1, wherein the first resin and the second resin are the same.

9. The electrostatic latent image developing carrier according to claim 1, wherein an amount of the first resin contained in the first coat layers relative to 100 parts by mass of the carrier cores is equal to that of the second resin contained in the second coat layers relative to 100 parts by mass of the carrier cores.

* * * * *